United States Patent [19]

Losehand et al.

[11] 4,012,660

[45] Mar. 15, 1977

[54] SIGNAL PLATE FOR AN ELECTRIC STORAGE TUBE OF HIGH WRITING SPEED

[75] Inventors: Reinhard Losehand; Wolfgang Welsch; Werner Veith, all of Munich, Germany

[73] Assignee: Siemens Aktiengesellschaft, Berlin & Munich, Germany

[22] Filed: Feb. 21, 1973

[21] Appl. No.: 334,361

Related U.S. Application Data

[63] Continuation of Ser. No. 130,880, April 5, 1971, abandoned.

[52] U.S. Cl. ..... 313/391; 313/367

[51] Int. Cl.[2] ..... H01J 29/41; H01J 29/36

[58] Field of Search ..... 313/65 AB, 66, 68 US, 313/392, 391, 366, 367, 384, 390, 394

[56] References Cited

UNITED STATES PATENTS

| | | | |
|---|---|---|---|
| 3,011,089 | 11/1961 | Reynolds | 313/367 X |
| 3,523,208 | 4/1970 | Bodmer et al. | 315/10 |
| 3,534,234 | 10/1970 | Clevenger | 317/235 |
| 3,548,233 | 12/1970 | Cave et al. | 313/65 AB X |
| 3,646,391 | 2/1972 | Hofstein | 313/65 AB X |
| 3,737,702 | 6/1974 | Kooi et al. | 313/66 |

OTHER PUBLICATIONS

Silver et al., "Electronic Image Storage Utilizing a Silicon Dioxide Target," IEEE Transactions on Electron Devices, vol. ED-18, No. 4; Apr. 1971.

*Primary Examiner*—Robert Segal
*Attorney, Agent, or Firm*—Hill, Gross, Simpson, Van Santen, Steadman, Chiara & Simpson

[57] ABSTRACT

A low capacitance high speed signal storage plate for a signal storage tube with a raster of insulating areas of 1 μm or greater thickness, and process for producing same. The insulating areas may be individual islands on a conductive plate, islands supported by projections extending from the plate, an integral layer supported by such projections, or islands carried on doped portions of a semiconductive plate.

2 Claims, 4 Drawing Figures

INVENTORS
Reinhard Losehand
Wolfgang Welsch
Werner Veith

BY Hill, Sherman, Meroni, Gross & Simpson ATTYS.

SIGNAL PLATE FOR AN ELECTRIC STORAGE TUBE OF HIGH WRITING SPEED

This is a continuation, of application Ser. No. 130,880 filed Apr. 5, 1971, now abandoned.

BACKGROUND OF THE INVENTION

1. Field of the Invention

This invention relates to a storage plate for signal storage tube for high speed writing, for use in the construction of for example, a vidicon tube having a beam generating system for producing an electron beam for writing, reading and erasing and a central deflecting device, in which tube there is generally provided on a conducting signal plate thin insulating spots (thin layers) of high secondary emission and/or low capacitance uniformly distributed in the form of a raster. This invention also is particularly concerned with the process for producing the signal plate.

2. Description of the Prior Art

A storage tube already known in the prior art and generally called a "lithocon" tube utilizes a silicon plate having a uniformly distributed raster of approximately 2000 × 2000 silicon dioxide spots arranged thereon as a storage medium. The resulting capacity of this tube permits aimed writing, reading and erasing with one and the same electron beam. The formation is then read without interference, the reading time with continuous reading amounting to approximately one hour. The recharging time for an image point is approximately 30 n sec. so that relatively high writing speeds are attainable.

The foregoing type of tube has special storage possibilities for gray values. The operating voltage is, in comparison to other known corresponding storage tubes, relatively low, having a maximum operating voltage of about 1000 volts. In this type of storage tube, the insulating spots are of $SiO_2$ arranged on a silicon signal plate having thickness up to 1 $\mu$m, because the oxidation process to provide greater thicknesses would require intolerably long times. In the scope of the functioning mechanism, the storage plate behaves as the determinative part of a triode, in which the surface potential of the storing insulating layer serves in a certain sense as the grid and the substrate which has good conductivity takes over the function of the anode. With such an arrangement it is possible to reproduce halftone images as long as only the potential of the storage islands (spots) is constantly more negative than the place of origin of the scanning electrons, that is, the cathode of the beam generating system.

The foregoing type of tube has, however, a serious drawback with respect to the magnitude to the writing speed to be achieved. This writing speed is defined by the expression $$v \sim \frac{J_p(\delta - 1)}{C \cdot \Delta U} \quad (1)$$

in which $J_p$ signifies the beam current, $\delta$ the secondary emission factor of the storing surface, C the capacitance of a storage element and $\Delta$ U the potential change impressed by the writing on the storage element.

SUMMARY OF THE INVENTION

Within the scope of the problem underlying the present invention, namely the increasing of the writing speed, there is to be omitted from consideration a trivial solution, such as would be obtained by increasing the current, to which, however, in the case of the vidicon type tube to a limit is set in consequence of the space charge present in front of the storage plate, as well as by its dissolving characteristic. Rather, there are here to be presented measures by which the two other factors according to the orginial expression are capable of being influenced in a favorable manner, namely $\delta$ and C portions of the expression.

The foregoing is realized in a storage plate of the type initially described for a signal storage tube, according to the present invention, by means that the signal plate consists of conducting or semiconducting material, such as, for example, silicon, tantalum, a gilded glass plate or a III-V compound and the insulating spots consist of a corresponding, appropriate oxide and/or other materials, preferably of high secondary emission (SE) properties, such as for example, magnesium oxide or potassium chloride.

Accordingly, metals and semiconductors with which in each case there can be produced on the surface relatively easily, very stable oxide layes of sufficient thickness are well suited for the signal plate. Unfortunately, however, the thicknesses of such oxide layers, as they are achieved within tolerable operation times, are always less than 1 $\mu$m.

Advantageously, therefore, instead of $SiO_2$, there is utilized for the insulating spots a material having a very high secondary emission factor, such as, for example, magnesium oxide. Then, in deviation from the method mentioned above, namely, the superficial oxidation of the storage plate concerned, the storage surface is itself, so to speak, metallurgically produced. The magnesium oxide (MgO) is provided as a powder which has worked up or suspended for this purpose in polyvinyl alcohol (PVA) and arranged and distributed in as tight as possible a packing on a flat and conductive substrate which serves as the signal plate. With the aid of a phototechnique which is well known in the art, the interspaces between the insulating islands to be formed are exposed and dissolved out and, furthermore, also the polyvinyl alcohol is removed by a temperature treatment. In this manner there is then provided a matrix of regular cylindrical islands of a material with an especially high secondary emission factor (SE). Layers of this type can be made very thick, for example 1 to 10 $\mu$m thick so that the requirements provided in expression (1) above for a high secondary emission factor as well as for a low capacitance can be fulfilled in order to achieve a high writing speed.

Here the substrate or underlayer, i.e., the signal plate, can consist of one of the previously mentioned metals, semiconductors, or of an insulator plate provided with a conducting layer.

Another measure for making the capacity of the storage layers particularly small, consist in that the proven build-up of $SiO_2$ islands on a silicon plate is retained and, in deviation from the well known production techniques, the medium which increases the capacitance is etched away underneath and between the insulating islands. By means of such an under-etching, the insulating sports are no longer supported over their entire lower surfaces, but are supported on a relatively small area by columns, bases or the like left standing and projecting from the substrate.

A further advantageous method in deviation from the foregoing, proceeds first of all also from a cohesive insulating layer (an integral layer generally co-extensive with the substrate) into which there are introduced regular, for example round, holes corresponding to a raster. Through these holes then the entire insulating layer is under-etched in such a manner that it is supported with the small-surfaced columns in a manner similar to that mentioned above between adjacent holes.

In a further advantageous production technique, the semiconductor properties of a signal plate is utilized in such a manner, as in operation through negative charges applied by the electron beam, so as to create an impoverished zone corresponding to a weak n-doping. The doping is provided as a raster which carries the islands of insulating material and the thickness (depth) of such an impoverished zone is determined in accordance with the expression $$w \sim \sqrt{\frac{U_{FB} - U}{Ne}} \qquad (2)$$

by the flat-band voltae $U_{FB}$ directly and inversely proportional to the degree of the Ne doping, by variation of these magnitudes the impoverishment can be driven relatively deep within the substrate.

BRIEF DESCRIPTION OF THE DRAWINGS

Other objects, features and advantages of the invention, its organization, construction and operation will be best understood from the following detailed description of particular embodiments thereof, taken in conjunction with the accompanying drawings, in which.

DESCRIPTION OF THE PREFERRED EMBODIMENTTS

Figure 1:
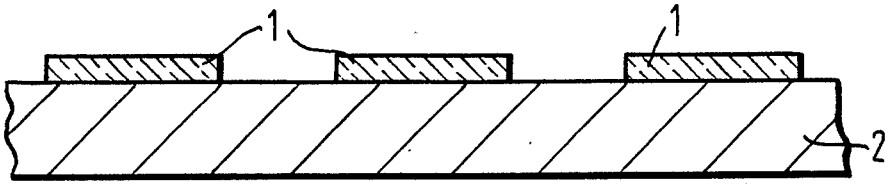
FIG. 1 is a fragmentary cross sectional view of the construction of a storage plate generally known in the prior art.

In FIG. 1 a plurality of insulating areas, or spots, of, for example, $SiO_2$ are arranged in the form of a matrix or raster on, for example, a silicon plate 2. By a photolacquering technique usual in semiconductor technology these storage areas 1 are formed by exposing and dissolving out after the signal plate has previously been cohesively oxidized as a layer of $SiO_2$. Unfortunately, these insulating layers, whether by thermal oxidation or by cold glow discharge, can be produced only to thicknesses of up to 1 $\mu$m. Greater thicknesses would require oxidation production times in the manufacturing process which would be altogether intolerable. Such low layer thicknesses, however, present very high capacitances of the storage layers, through which, in turn, the writing speed of the tubes concerned is adversely affected.

A first advantageous improvement of the foregoing storage plate for increasing the writing speed comprises the use of magnesium oxide instead of silicon oxide, which has both a high secondary emission factor, and also makes possible a considerably greater thickness. Proceeding from magnesium oxide (MgO) powder, suspended in polyvinyl alcohol, a layer of this material is deposited on the signal plate 2 proper and, by usual photographic techniques, the interspaces are dissolved out to form the cylindrical islands 1 illustrated in FIG. 1 in the range from 1 to 10 $\mu$m in thickness.

Other techniques are illustrated in other figures for considerably lowering the capacitances to increasing the writing speed.

Figure 2:
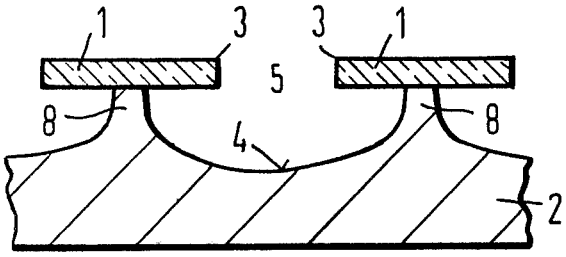
FIG. 2 is a fragmentary cross sectional view of a storage plate according to an embodiment of the invention.

In FIG. 2, for example, on a silicon plate 2 in the usual manner, the insulating spots 1 are arranged in such a way that between them there are present free interspaces 5. Through these interspaces 5, columns, bases or the like 8 are formed as projections from the silicon plate 2 by etching away portions of the silicon plate 2 beneath the edges of three of the insulating spots 1. The edges 3 of the storage layers at the interspaces 5 are determinative for the control of the reading beam by the charges stored up during operation of the tube so that they must have a sufficient distance from the hollowed out base 4 which is formed during the etching process. The influence of the remaining central support is, however, very slight and, therefore, without determinative influence on the control of the electron beam during reading.

Figure 3:
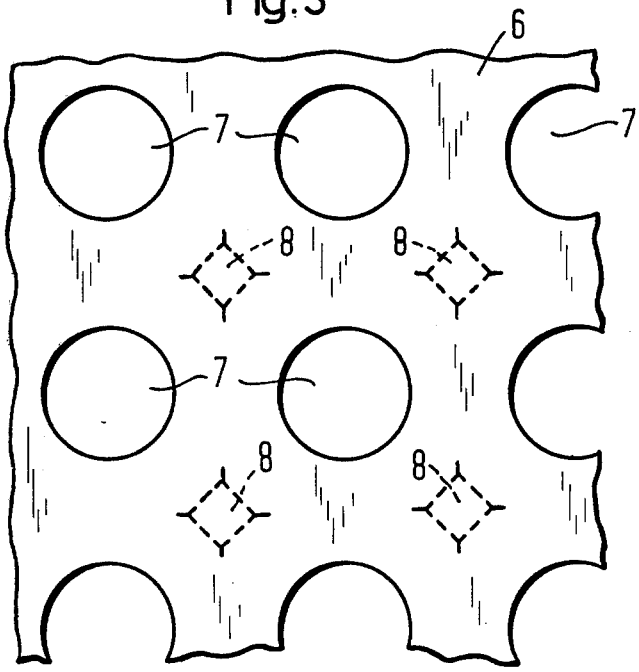
FIG. 3 is a plan view of a portion of a storage plate according to another embodiment of the invention.

Still more favorable influence on the storage layer is achieved with the arrangement illustrated in FIG. 3. In this arrangement first of all there is provided an insulating layer 6 over the substrate. Then, a raster of holes 7 are inroduced through the insulating layer 6. Then, through the hole 7, an under-etching of the carrier is performed to produce the projections 8 between adjacent holes 7. The spot constituent of the insulating layer and, thereby, also of the resulting capacity of the tube are increased to a considerable degree over those of the previous example. Such a cohesive, under-hollowed insulating layer 6 can be produced also by powdermetallurgical techniques utilizing, for example, magnesium oxide, i.e., a material which has a high secondary emission factor (SE) to permit an increase in the writing speed.

Figure 4:
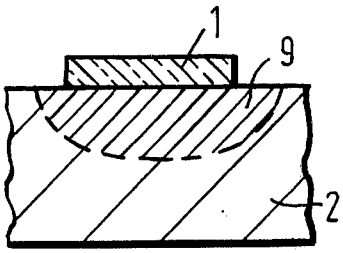
FIG. 4 is a fragmentary cross sectional view of a storage plate in accordance with another embodiment of the invention.

Referring to FIG. 4, the example of execution there presented utilizes the electrical properties of a semiconductor for the signal plate. As is well known, through the surface state at the boundary layer insulatorsemiconductor, as well as through ionic charges in the insulator, the conduction bands on the surface are bent. A technique for providing this bending is the utilization of the flat-band voltage $U_{FB}$. In the operation of the storage tube concerned, during reading a positive voltage is always applied to the rear wall of the storage plate in such a manner that the surface of the storage layer always has a negative potential U with respect to the back. Under these circumstances, a weak n-doping of the silicon surface has a favorable effect; the result an impoverished zone, such as designated with the reference character 9 in FIG. 4. The thickness of the impoverished zone is determined by the expression $$w \sim \sqrt{\frac{U_{FB} - U}{Ne}}$$

for the case that $U_{FB}$ and U>O. In order then to obtain as low as possible a capacitance, it is essential to select the doping according to this expression in such a way that the factor Ne becomes sufficiently small.

The processes described can be used both individually and also in combinations. Neither are they, however, restricted to the use of silicon as the semiconducting material, but there can also be utilized as suitable material, rather, also metals which easily form well-insulating oxides, such as, for example, aluminum and tantalum. Depending on the writing and reading process chosen, determined by the plate potential formed in each case, the diameter of the insulating spots will be selected as various large diameters in relation to the period of the raster, or also the diameter of the openings will be chosen at various large dimensions in relation to the period of the raster.

For the various functions such as reading, writing and erasing, which are achieved by the choice of the plate voltage $U_p$ the following example is given as having practical values.

1. Compensation of earlier charges: plate voltage $U_p$ = 300 V = potential of the field network.

2. Applying of a uniform negative charge to the surace: plate voltage = 8 V. The voltage is chosen in such a way that the incident energy lies below the first 1-point of the secondary emission curve. Then the entire surface of the insulating islands is charged to 0 volt (cathode potential), which means a voltage difference to the substrate of −8 V.

3. Writing:

a. Writing with negative charge: the plate voltage $U_p$ = +20 V. The surface receives a voltage =12 V.

b. Writing with a positive charge: plate voltage in the maximum of the secondary emission curve, for example, +200 V. The surface then has a voltage of +192 V. Through incident electrons positive charge is applied which is determined upward only by the plate voltage of +200 V.

4. Reading:

a. Plate voltagevoltage 8 V.

b. Plate Voltage 4 V.

Many changes and modifications may be made in our invention by one skilled in the art without departing from the spirit and scope thereof, and it is to be understood that we intend to include within the patent warranted hereon all such changes and modifications as may reasonably and properly be included within the scope of our contribution to the art. Other modification of this invention will be readily apparent to those skilled in the art; for example instead of n-doped silicon it is also possible to use p-doped silicon.

What we claim as our invention is:

1. An electron beam charge storage device comprising a target structure, means for generating and directing an electron beam over one face of said target, said target comprising a plurality of storage elements providing storage surfaces lying in a first plane and insulated from each other and capable of holding a charge in response to electron bombardment, support means for said storage elements provided on the opposite side of said first plane with respect to said means for generating said electron beam, said support means comprising a substrate comprising individual extending support pillars for each of said storage elements in which the cross section of said support pillars is of a smaller area than said storage surface, said support means providing an electron collecting means lying in a second plane space from said first plane of storage surfaces, said collecting means on the opposite side of said first plane with respect to said means for generating an electron beam.

2. The device in claim 1 in which the material of said support means is silicon and the material of said storage surface is silicon dioxide.

* * * * *